US012590403B2

(12) United States Patent
Wawrzusiak

(10) Patent No.: US 12,590,403 B2
(45) Date of Patent: Mar. 31, 2026

(54) COMBINATION LAUNDRY APPLIANCE WITH HEAT PUMP ASSEMBLY

(71) Applicant: WHIRLPOOL CORPORATION, Benton Harbor, MI (US)

(72) Inventor: Miron Wawrzusiak, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 275 days.

(21) Appl. No.: 18/103,795

(22) Filed: Jan. 31, 2023

(65) Prior Publication Data

US 2024/0254683 A1 Aug. 1, 2024

(51) Int. Cl.

| | |
|---|---|
| ***D06F 58/20*** | (2006.01) |
| ***D06F 33/70*** | (2020.01) |
| ***D06F 39/04*** | (2006.01) |
| ***D06F 39/08*** | (2006.01) |
| ***D06F 105/56*** | (2020.01) |

(52) U.S. Cl.

CPC ..... *D06F 58/206* (2013.01); *D06F 33/70* (2020.02); *D06F 39/04* (2013.01); *D06F 39/085* (2013.01); *D06F 2105/56* (2020.02)

(58) Field of Classification Search

CPC ..... D06F 25/00–065; D06F 39/04; D06F 39/083; D06F 39/085

See application file for complete search history.

(56) References Cited

U.S. PATENT DOCUMENTS

| | | | | |
|---|---|---|---|---|
| 8,112,903 B2 | | 2/2012 | Favret et al. | |
| 10,099,263 B2 | | 10/2018 | Cagnasso et al. | |
| 2014/0109428 A1 | | 4/2014 | Kim et al. | |
| 2015/0150431 A1 | * | 6/2015 | Olausson | A47L 15/4225 417/366 |
| 2022/0349105 A1 | | 11/2022 | Kellow et al. | |

FOREIGN PATENT DOCUMENTS

| | | | | | |
|---|---|---|---|---|---|
| CN | 107022866 A | * | 8/2017 | ..... | D06F 58/20 |
| CN | 109695134 A | * | 4/2019 | | |
| EP | 3034675 A1 | * | 6/2016 | ..... | D06F 25/00 |
| EP | 3034674 B1 | | 8/2017 | | |
| EP | 3309293 A1 | | 4/2018 | | |

(Continued)

OTHER PUBLICATIONS

EP3034675A1 Machine Translation (Year: 2016).*

(Continued)

*Primary Examiner* — Spencer E. Bell

(74) *Attorney, Agent, or Firm* — Price Heneveld LLP

(57) ABSTRACT

A combination laundry appliance includes a cabinet, a drum disposed within the cabinet, a fluid directing system for directing wash fluid into the drum during a wash cycle and directing air into the drum during a dry cycle, and a heat pump assembly operably coupled to the fluid directing system. The heat pump assembly includes a first condenser, a second condenser, and a three-way valve. The three-way valve is configured to direct refrigerant to the first condenser during the wash cycle to heat the wash fluid and to the second condenser during the dry cycle to heat the air. A controller is communicatively coupled to the heat pump assembly. The controller is configured to control the three-way valve to direct the refrigerant based on a laundry cycle.

18 Claims, 7 Drawing Sheets

(56) References Cited

FOREIGN PATENT DOCUMENTS

| | | | | |
|---|---|---|---|---|
| EP | 3124668 | B1 | 4/2021 | |
| WO | 2014082970 | A1 | 6/2014 | |
| WO | 2014095658 | A1 | 6/2014 | |
| WO | WO-2015070900 | A1 * | 5/2015 | ..... F28D 1/05391 |
| WO | 2015139472 | A1 | 9/2015 | |
| WO | 2016112661 | A1 | 7/2016 | |
| WO | 2017089906 | A1 | 6/2017 | |

OTHER PUBLICATIONS

CN109695134A Machine Translation (Year: 2019).*
CN107022866A Machine Translation (Year: 2017).*
Haier, "ATW Service Manual", SYJS-2021.B, Release: 2021.B, (p. 15), Grudziadz, Poland.

* cited by examiner

COMBINATION LAUNDRY APPLIANCE WITH HEAT PUMP ASSEMBLY

BACKGROUND OF THE DISCLOSURE

The present disclosure generally relates to a combination laundry appliance, and more specifically, to a combination laundry appliance with a heat pump assembly.

SUMMARY OF THE DISCLOSURE

According to one aspect of the present disclosure, a combination washer and dryer includes a cabinet, a drum disposed within the cabinet, and a liquid directing system disposed within the cabinet. The liquid directing system is configured to direct liquid into the drum for a wash cycle. An air directing system is disposed within the cabinet and is configured to direct air into the drum for a dry cycle. A heat pump assembly is operably coupled to the liquid directing system and the air directing system. The heat pump assembly includes an evaporator, a first condenser in fluid communication with the evaporator, a second condenser in fluid communication with the evaporator, and a valve operably coupled to the first and second condensers. The valve is configured to direct refrigerant to the first condenser during the wash cycle to heat a wash fluid and to the second condenser during the dry cycle to heat the air. A heater is disposed within the cabinet. The heater is configured to selectively heat the wash fluid during a predefined mode of operation of the wash cycle. A controller is communicatively coupled to the heat pump assembly to control the valve to direct the refrigerant based on a laundry cycle.

According to another aspect of the present disclosure, a combination laundry appliance includes a cabinet, a drum disposed within the cabinet, a fluid directing system for directing wash fluid into the drum during a wash cycle and directing air into the drum during a dry cycle, and a heat pump assembly operably coupled to the fluid directing system. The heat pump assembly includes a first condenser, a second condenser, and a three-way valve. The three-way valve is configured to direct refrigerant to the first condenser during the wash cycle to heat the wash fluid and to the second condenser during the dry cycle to heat the air. A controller is communicatively coupled to the heat pump assembly. The controller is configured to control the three-way valve to direct the refrigerant based on a laundry cycle.

According to yet another aspect of the present disclosure, a method of controlling a combination laundry appliance includes starting a wash cycle in a drum of said combination laundry appliance and activating a heat pump assembly to direct refrigerant through the heat pump assembly, where the heat pump assembly having a first condenser and a second condenser. The method also includes adjusting a three-way valve to a first state to direct the refrigerant through the first condenser during the wash cycle to heat wash fluid to be directed into the drum, starting a dry cycle in the drum upon completion of the wash cycle, and adjusting the three-way valve to a second state to direct the refrigerant through the second condenser during the dry cycle to heat air to be directed into the drum.

These and other features, advantages, and objects of the present disclosure will be further understood and appreciated by those skilled in the art by reference to the following specification, claims, and appended drawings.

Figure 1:
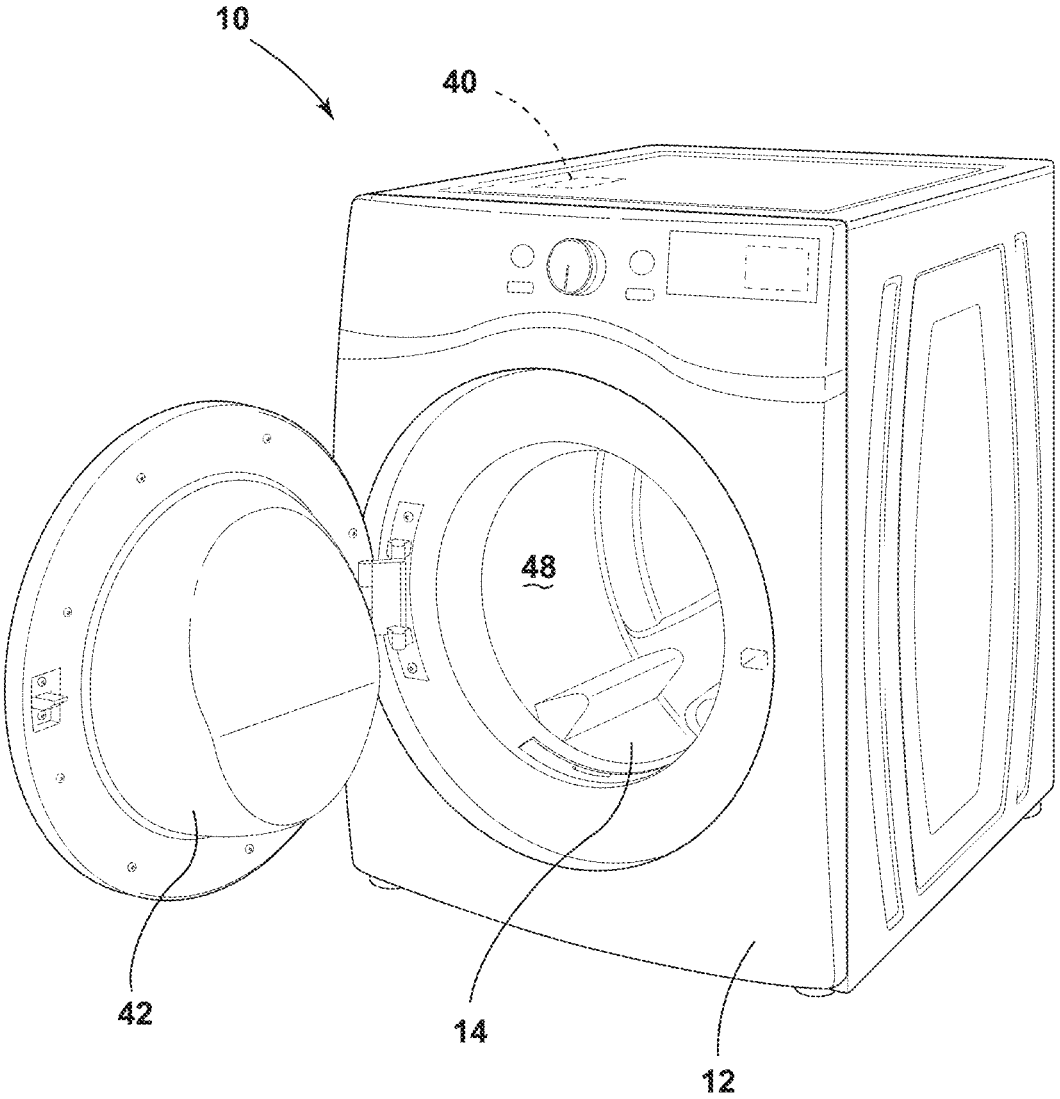
FIG. 1 is a side perspective view of a combination laundry appliance, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a combination laundry appliance with a heat pump assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

With reference to FIGS. 1-10, reference numeral 10 generally designates a laundry appliance 10 that includes a cabinet 12 and a drum 14 disposed within the cabinet 12. A liquid directing system 16 is disposed within the cabinet 12 and configured to direct a wash fluid 18 into the drum 14 for a wash cycle 20. An air directing system 22 is disposed within the cabinet 12 and configured to direct air 24 into the drum 14 for a dry cycle 26. A heat pump assembly 28 is operably coupled with the liquid directing system 16 and the air directing system 22. The heat pump assembly 28 includes an evaporator 30, a first condenser 32 in fluid communication with the evaporator 30, a second condenser 34 in fluid communication with the evaporator 30, and a valve 36 operably coupled to the first and second condensers 32, 34. The valve 36 is configured to direct refrigerant 102 to the first condenser 32 during the wash cycle 20 to heat the wash fluid 18 and to the second condenser 34 during the dry cycle 26 to heat the air 24. The laundry appliance 10 also includes an electric heater 38 disposed within the cabinet 12, which is configured to selectively heat the wash fluid 18 during a predefined mode of operation of the wash cycle 20. A controller 40 is communicatively coupled to the heat pump assembly 28 to control the valve 36 to direct the refrigerant 102 based on a laundry cycle.

Figure 2:
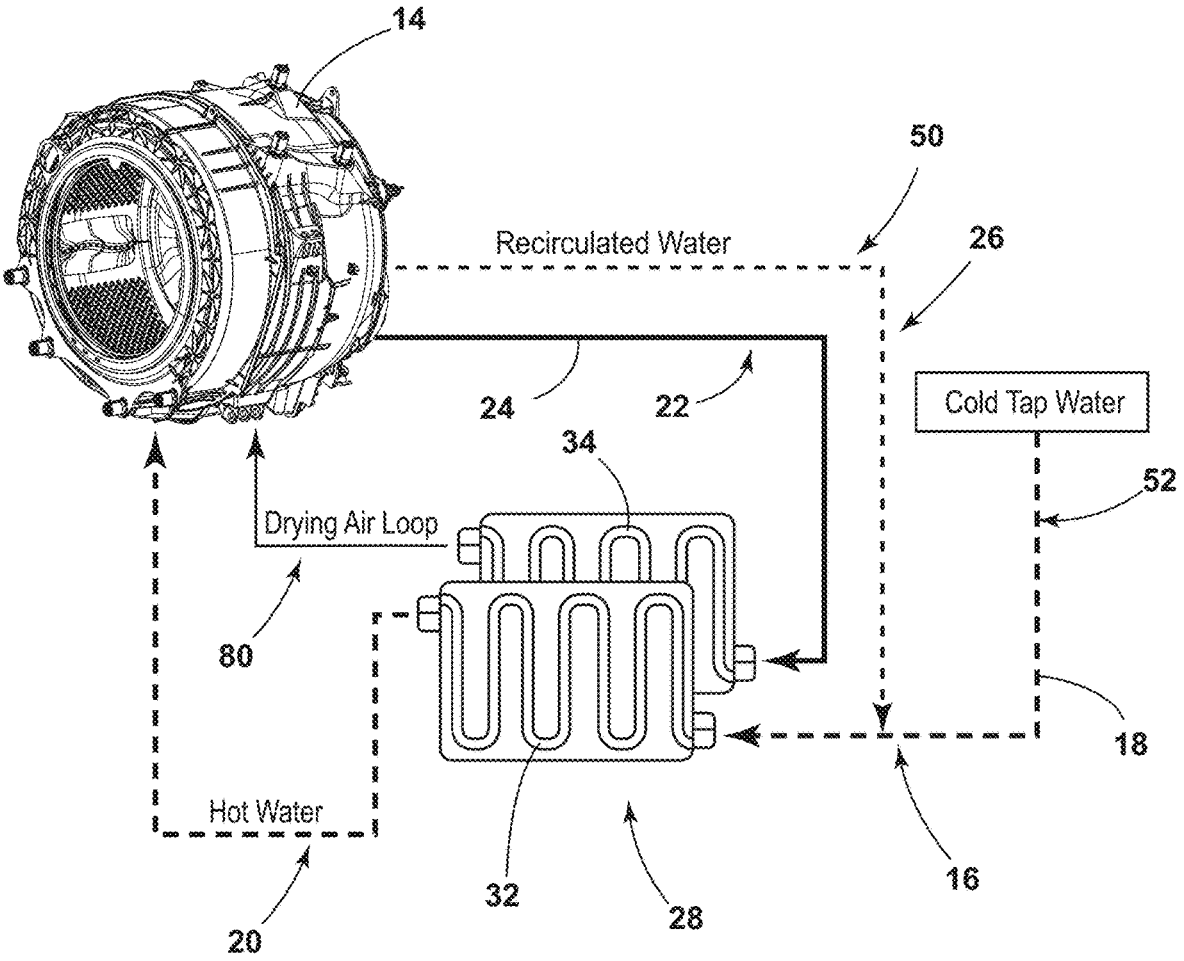
FIG. 2 is a schematic view of a drum for a laundry appliance and condensers of a heat pump assembly relative to a liquid flow path and an airflow path for the drum, according to the present disclosure.

Referring to FIGS. 1 and 2, the laundry appliance 10 is illustrated as a combination washer and dryer 10, which may also be referred to as a combination washing/drying appliance 10 or a combination laundry appliance 10. The laundry appliance 10 includes the cabinet 12 with the drum 14 disposed within an interior of the cabinet 12. The combination laundry appliance 10 includes a single drum 14 configured to receive items for both the wash cycle 20 or phase and the dry cycle 26 or phase within the same drum 14. Accordingly, the combination laundry appliance 10 may perform a laundry cycle within the drum 14 that includes both the wash phase 20 and the dry phase 26.

The drum 14 is a rotating drum 14 configured to be driven about a rotational axis, which is typically a horizontal axis, as shown in the illustrated configuration. The drum 14 is configured to receive items, which can include but are not limited to, fabric, clothing, linens, other wearable items, and other similar items typically cleaned with the laundry appliance 10. The laundry appliance 10 includes a door 42 operably coupled to the cabinet 12 for selectively enclosing and accessing an interior 48 of the drum 14 for adding and removing items from the drum 14.

The laundry appliance 10 includes a fluid directing system 50 for directing fluid within the laundry appliance 10 during the laundry cycle (e.g., the wash phase 20 and/or the dry phase 26). The fluid directing system 50 includes the liquid directing system 16 for directing the wash fluid 18 along a liquid flow path 52. The liquid directing system 16 is used for directing the wash fluid 18 into the drum 14 and recirculating the wash fluid 18 during the wash cycle 20. The wash fluid 18 generally includes at least water, laundry chemistry, and combinations thereof. The liquid directing system 16 includes a water inlet 60, which is in fluid communication with a water source, for directing fresh water into the laundry appliance 10, or for directing recirculated wash fluid 18 within the laundry appliance 10. The water is directed from the water inlet 60, through a valve 62, and to a dispenser 64. The dispenser 64 holds laundry chemistry, which mixes with the water as the water is directed through the dispenser 64. The wash fluid 18, which includes one or both of water and laundry chemistry, is directed through a dispenser tube 66 and into the drum 14 to interact with the items therein during the wash cycle 20. Over the course of the laundry cycle, portions of the wash fluid 18 are typically recirculated through the appliance 10.

Figure 3:
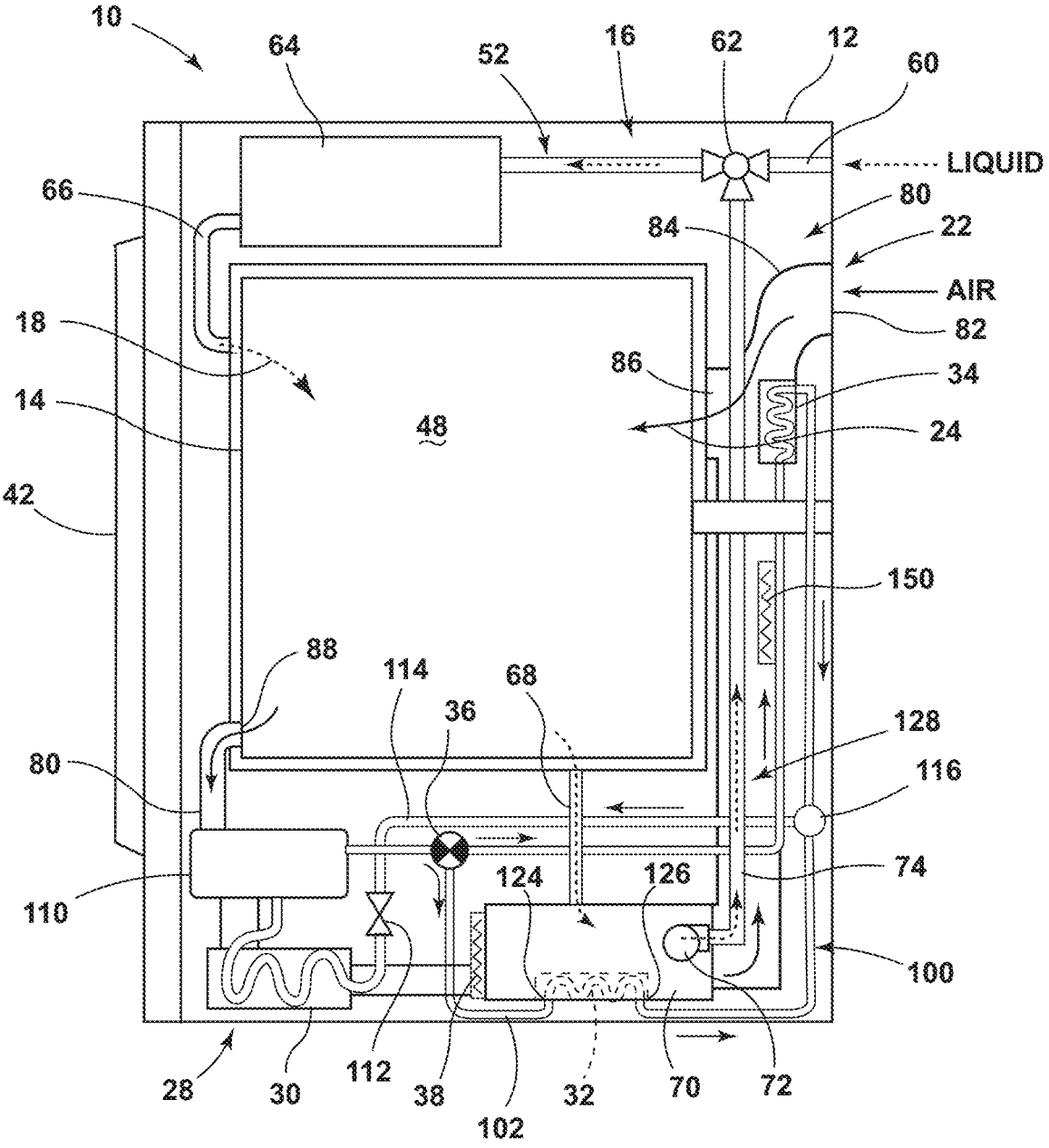
FIG. 3 is a schematic cross-sectional view of a combination laundry appliance having a dual condenser heat pump assembly, according to the present disclosure.

Referring still to FIGS. 1-3, the wash fluid 18 is drained from the drum 14 via a drain line 68, which is configured to direct the wash fluid 18 to a reservoir 70. The reservoir 70 may be a sump, a container, or any practicable structure for holding and/or storing the wash fluid 18. It is also contemplated that the reservoir 70 may be included in or configured as a removable container for removing and dispensing of the wash fluid 18 after the laundry cycle.

A pump 72 is in fluid communication with the reservoir 70 for directing the wash fluid 18 through a recirculation line 74, the valve 62, and back to the drum 14. In the illustrated configuration, the wash fluid 18 is directed by the valve 62 from the recirculation line 74 through the dispenser 64. However, an additional recirculation line 74 may be utilized for bypassing the dispenser 64 for delivering the recirculated wash fluid 18 to the drum 14. The fresh water from the water inlet 60 may be added at the start of a wash cycle 20 and/or may continually be added during the wash cycle.

The combination laundry appliance 10 is also used to perform the dry cycle 26 to dry the items within the same drum 14. Accordingly, the fluid directing system 50 includes the air directing system 22 configured to direct the air 24 along an airflow path 80 within the laundry appliance 10. The cabinet 12 generally defines an air inlet 82 for drawing air 24 into the laundry appliance 10. The air inlet 82 is in fluid communication with ducting 84, which directs the air 24 to the interior 48 of the drum 14 through a drum air inlet 86. The drum 14 also includes an air outlet 88 on an opposing side of the drum 14 relative to the drum air inlet 86. In this way, the air 24 is directed across the drum 14 and, consequently, across the items disposed within the drum 14 during the dry cycle 26. The air 24 directed across the drum 14 assists in removing moisture from the drum 14 and items, and therefore, dries the items. The air 24 is directed out of the drum 14 via the air outlet 88 and through the ducting 84 to be recirculated back into the drum 14. Upon completion of the dry cycle 26, the air 24 may be exhausted from the laundry appliance 10.

Referring still to FIG. 2, as well as FIG. 3, the combination laundry appliance 10 includes a heat pump assembly 28 having a refrigerant circuit 100 fluidly coupling various components of the heat pump assembly 28. The heat pump assembly 28 is configured to direct a refrigerant 102 through the refrigerant circuit 100 for adjusting a temperature of each of the wash fluid 18 and the air 24 during the respective phase of the laundry cycle, as described further herein. The heat pump assembly 28 includes the first condenser 32, which is configured to heat the wash fluid 18 during the wash cycle 20, and the second condenser 34, which is configured to heat the air 24 during the dry cycle 26. Further, the heat pump assembly 28 includes the evaporator 30 in fluid communication with each of the first condenser 32 and the second condenser 34. During the dry cycle 26, the air 24 is directed across the evaporator 30, which is configured to cool the air 24 and remove moisture from the air 24. Where it is not necessary for air 24 to be heated, the cooling function of the evaporator 30 can be used for other purposes, such as charging a heat sink, cooling the surrounding environment, and other purposes where heat may need to be extracted from a media and absorbed into the evaporator 30.

Figure 4:
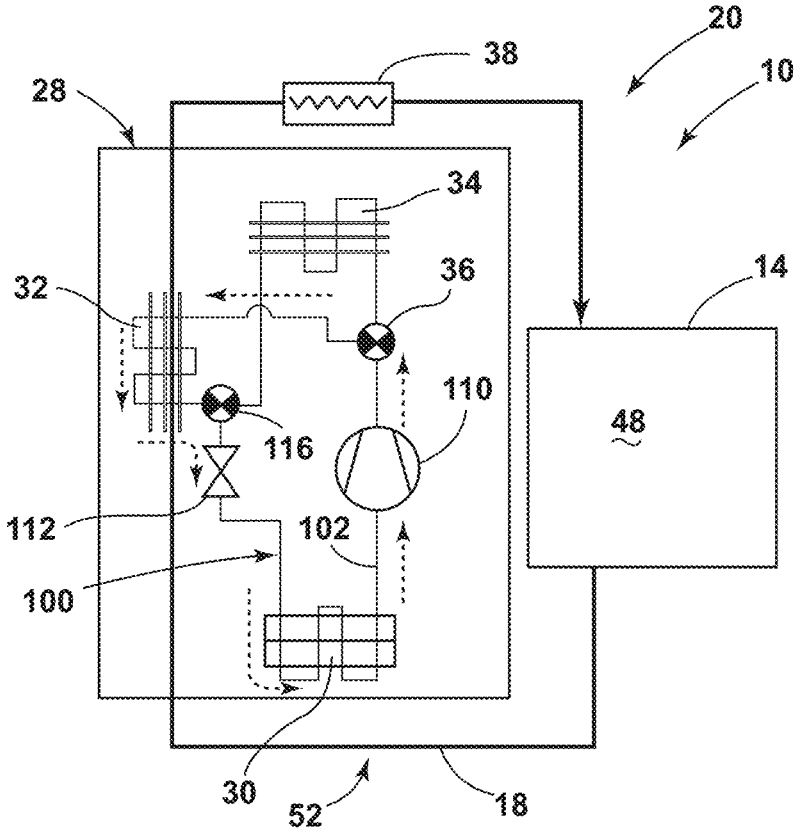
FIG. 4 is a schematic diagram of a liquid flow path relative to a heat pump assembly and a drum for a combination laundry appliance during a wash cycle, according to the present disclosure.
Figure 5:
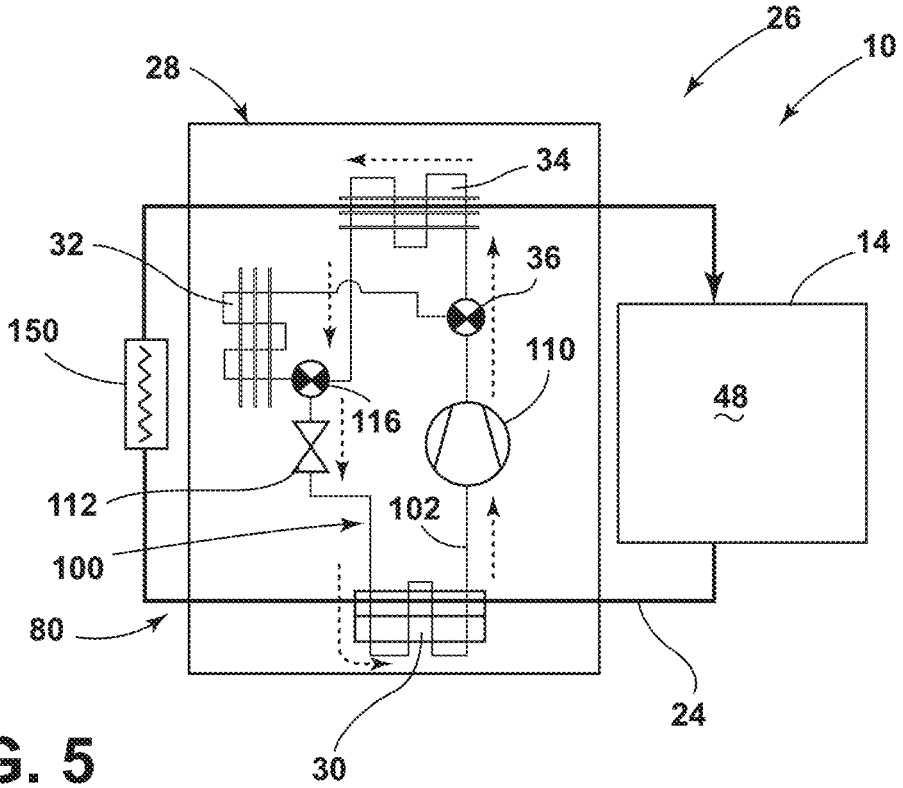
FIG. 5 is a schematic diagram of an airflow path relative to the heat pump assembly and the drum for the combination laundry appliance of FIG. 4 during a dry cycle, according to the present disclosure.

Referring still to FIG. 2, as well as FIGS. 4 and 5, the heat pump assembly 28 is configured to adjust the temperature of the fluid (e.g., the wash fluid 18 or the air 24) based on the phase of the laundry cycle being performed by the combination laundry appliance 10. The heat pump assembly 28 is disposed within the cabinet 12 and may be arranged in any practicable configuration for affecting the temperature of the wash fluid 18 and the drying air 24. Accordingly, the positions of the various components of the heat pump assembly 28, as illustrated in FIG. 2, are merely exemplary and are not meant to be limiting.

The heat pump assembly 28 includes a compressor 110, the first condenser 32, the second condenser 34, an expansion device or valve 112, and the evaporator 30. The refrigerant 102 is directed through a refrigerant line 114 that extends the refrigerant circuit 100 and fluidly connects the various components of the heat pump assembly 28. The compressor 110 is configured to control or create circulation of the refrigerant 102, which acts as a pump or motor. The compressor 110 pressurizes the refrigerant 102 by compressing the refrigerant gas 102, decreasing the volume of the refrigerant 102, and creating a pressure difference that drives the refrigerant 102 through the refrigerant circuit 100 in a continuous cycle.

From the compressor 110, the refrigerant 102 is directed to the three-way valve 36, which is configured to direct the refrigerant 102 to either the first condenser 32 or the second condenser 34 based on the laundry cycle. The three-way valve 36 is operable between a first state, directing the refrigerant 102 to the first condenser 32, and a second state, directing the refrigerant 102 to the second condenser 34. When the three-way valve 36 is in the first state, the refrigerant 102 bypasses the second condenser 34, and when the three-way valve 36 is in the second state, the refrigerant 102 bypasses the first condenser 32. Typically, the three way valve 36 will be operable to deliver the refrigerant 102 the first condenser 32, the second condenser 34, but not both.

Each of the first and second condensers 32, 34 are configured to cool and condense the refrigerant gas 102 received from the compressor 110 into a vapor and then to a liquid. Through the process of cooling and condensing the refrigerant 102, the first and second condensers 32, 34 are configured to emit the heat generated by the conversion of the refrigerant 102 from a gaseous state to a liquid state. Accordingly, the heat pump assembly 28 is a dual-condenser 32, 34 heat pump assembly 28.

Referring still to FIGS. 4 and 5, the refrigerant 102 is directed from the first condenser 32, or the second condenser 34, to a valve 116, such as a check valve 116. The check valve 116 is configured to prevent backflow of the refrigerant 102 into either of the first and second condensers 32, 34. From the check valve 116, the refrigerant 102 is directed to the expansion valve 112. The expansion valve 112 is configured to control the flow of the liquid refrigerant 102 into the evaporator 30.

The refrigerant 102 is directed from the expansion valve 112 and through the evaporator 30. The evaporator 30 is configured to absorb heat as the refrigerant 102 flowing through the evaporator 30 is converted from a liquid to a gas, thereby absorbing heat as a result of this reaction. The refrigerant 102 then moves at a slower pace to absorb a maximum amount of heat. As the refrigerant 102 absorbs heat, the refrigerant 102 turns into a gas. By vaporizing, the refrigerant 102 absorbs more heat. Heat from the heated and humid air 24 is absorbed by the evaporator 30, thereby cooling the air 24 and condensing the moisture within the humid air 24 as condensate. As a result, the air is cooled and dehumidified through the operation of the refrigerant moving through the evaporator 30. The refrigerant 102 is then directed back to the compressor 110, in a heated gaseous form, to again be compressed by the compressor 110. Overall, the heat pump assembly 28 includes three heat exchangers 26, 32, 34, with one evaporator 30 and two condensers 32, 34. The two condensers 32, 34 are arranged in parallel in the refrigerant circuit 100. Accordingly, the refrigerant 102 is directed through one of the two condensers 32, 34 but not both simultaneously.

Referring still to FIG. 4, the liquid flow path 52 is illustrated relative to the components of the heat pump assembly 28 and the drum 14. The wash fluid 18 that is drained from the drum 14 is directed along the liquid flow path 52, flowing adjacent to or across the first condenser 32. As the wash fluid 18 is directed across the first condenser 32, the heat emitted from the first condenser 32 is transferred to the wash fluid 18. The warmed or heated wash fluid 18 then continues along the liquid flow path 52 to be delivered back into the drum 14. During the wash cycle 20, the wash fluid 18 is recirculated, and with each recirculation, the wash fluid 18 is directed across the first condenser 32 to continually heat the wash fluid 18.

In various aspects, the water directed from the water inlet 60 may be directed across the first condenser 32. In this way, the water (e.g., the wash fluid 18) may be warmed or heated as the water is directed through the dispenser 64 and into the drum 14 and then continually warmed during the recirculation during the wash cycle 20.

Figure 6:
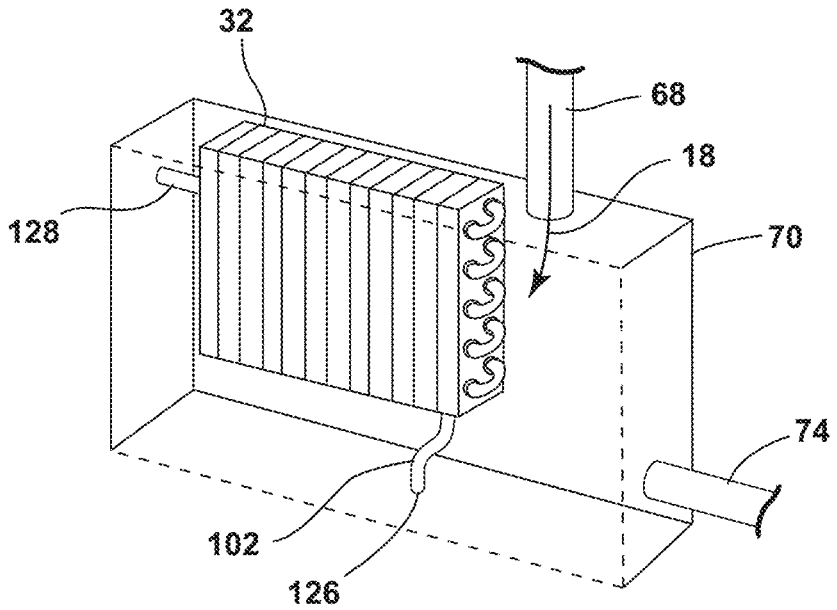
FIG. 6 is a side perspective view of a condenser within a reservoir for heating a wash fluid in a laundry appliance, according to the present disclosure.
Figure 7:
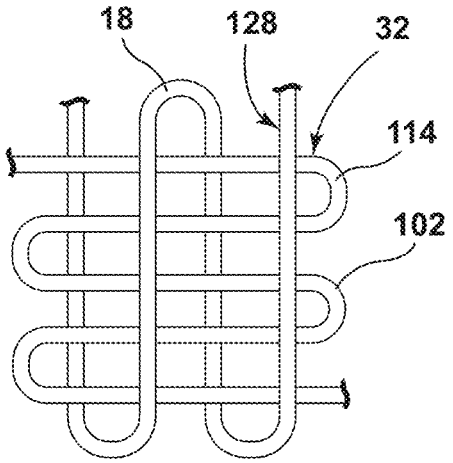
FIG. 7 is a partial side elevational view of a refrigerant line of a condenser and a liquid line in an overlapping configuration for heating a wash fluid within the liquid line, according to the present disclosure.
Figure 8:
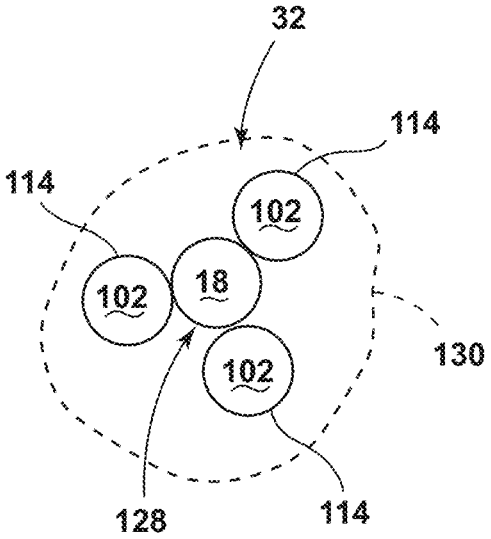
FIG. 8 is a cross-sectional view of a co-extruded body having refrigerant lines and a liquid line for heating wash fluid in the liquid line, according to the present disclosure.

Referring still to FIG. 4, as well as FIGS. 6-8, the wash fluid 18 may flow over the first condenser 32 or be in close proximity with the first condenser 32, or other practicable configurations for maximizing the heat transfer from the first condenser 32 to the wash fluid 18. For example, as illustrated in FIG. 6, the first condenser 32 is disposed in or operably coupled with the reservoir 70. The wash fluid 18 is directed into the reservoir 70 from the drain line 68 and directed out of the reservoir 70 via the recirculation line 74 and the pump 72. The first condenser 32 is disposed in the reservoir 70 with a refrigerant inlet 124 and a refrigerant outlet 126 of the first condenser 32 extending into and out of the reservoir 70, respectively. In this configuration, the wash fluid 18 is delivered to the reservoir 70 around the first condenser 32. The wash fluid 18 may directly contact and remain in contact with the first condenser 32 to receive the heat emitted from the first condenser 32 before being recirculated out of the reservoir 70 via the pump 72.

In such an aspect of the device, the first condenser 32 can be positioned within a lower section of the reservoir 70. As portions of the wash fluid 18 heat, this fluid will rise and allow cooler fluid 18 to fall to the lower section of the reservoir 70 to be heated by the first condenser 32. Additionally, the first condenser 32 can be positioned within an upper section of the reservoir 70 to provide heat, though a longer period of time, to the immediately adjacent wash fluid 18 in the reservoir 70.

Further, the first condenser 32 in FIG. 6 is illustrated as a fin-and-tube condenser 32. The fin-and-tube condenser 32 may maximize a surface area of the condenser 32 that is configured to emit heat. In this way, the heat transfer to the wash fluid 18 may occur more efficiently, maximizing the heat transfer to the wash fluid 18 while the wash fluid 18 remains in the reservoir 70.

Referring to FIG. 7, a liquid line 128 and the refrigerant line 114 may be coiled together in various patterns to maximize contact and, therefore, heat transfer therebetween. The liquid line 128 may be the drain line 68, the recirculation line 74, the water inlet 60, or any other tubing for directing the wash fluid 18 along the liquid flow path 52. The liquid line 128 may form a first serpentine pattern, while the refrigerant line 114 forms a second serpentine pattern. The two serpentine patterns may be perpendicular to one another or may be parallel to one another to form a coiling and/or overlapping configuration. The coiled and overlapping configuration maximizes the surface area of the refrigerant line 114 of the first condenser 32 that is abutting or adjacent to the liquid line 128. The maximized surface area or contact may be advantageous for maximizing heat transfer from the refrigerant line 114 of the first condenser 32 to the liquid line 128, and consequently, the wash fluid 18 within the liquid line 128.

Referring to FIG. 8, one or more refrigerant lines 114 may be coupled with the liquid line 128 or coextruded with the liquid line 128. In this way, multiple refrigerant lines 114 may abut or be adjacent to the liquid line 128. In various configurations, the refrigerant lines 114 may surround the liquid line 128, allowing heat to transfer to the wash fluid 18 from multiple directions. The refrigerant lines 114 and the liquid line 128 may be coextruded into a surrounding body 130. In this way, the refrigerant line 114 and the liquid line 128 remain in contact or adjacent to one another to maximize the heat transfer from the refrigerant line 114 of the first condenser 32 to the liquid line 128. Similar to the coiling and overlapping configuration of FIG. 7, the coextruded configuration of FIG. 8 may be included in one or more locations within the laundry appliance 10, such that the liquid line 128 may be the drain line 68, the recirculation line 74, the water inlet 60, or any other tubing for directing the wash fluid 18 along the liquid flow path 52.

Referring again to FIG. 4, the laundry appliance 10 may include the electric heater 38 operably coupled with the liquid flow path 52. The electric heater 38 may direct heat to the fresh water and/or the recirculated wash fluid 18. The electric heater 38 may be configured to supplement the heating of the wash fluid 18 performed by the first condenser 32.

Supplementing the heating by the first condenser 32 may shorten a wash time for the wash cycle 20 by heating the wash fluid 18 more quickly. In various examples, the wash fluid 18 is configured to be heated from about 7° C. to a range between about 40° C. and about 50° C. In certain aspects, the first condenser 32 is configured to heat the wash fluid 18 to this predefined range in a first predefined mode of operation, which reduces the energy consumption of the laundry appliance 10 (e.g., conserves energy). In a second predefined mode of operation, both the first condenser 32 and the electric heater 38 are configured to heat the wash fluid 18 to this predefined temperature range, which may be advantageous for reaching the predefined temperature in a shorter time and shortening the wash time.

The wash fluid 18 is directed along the first condenser 32 during the wash cycle 20. Accordingly, the refrigerant 102 is directed through the first condenser 32 during the wash cycle 20. In this way, the three-way valve 36 is in the first state, directing the refrigerant 102 through the first condenser 32 and bypassing the second condenser 34. During the wash cycle 20, the refrigerant 102 is not moved through the second condenser 34 such that little or no heat is emitted by the second condenser 34. Accordingly, during the wash cycle 20, substantial heat is emitted by the first condenser 32 to heat the wash fluid 18, and minimal or no heat is emitted by the second condenser 34.

Figure 9:
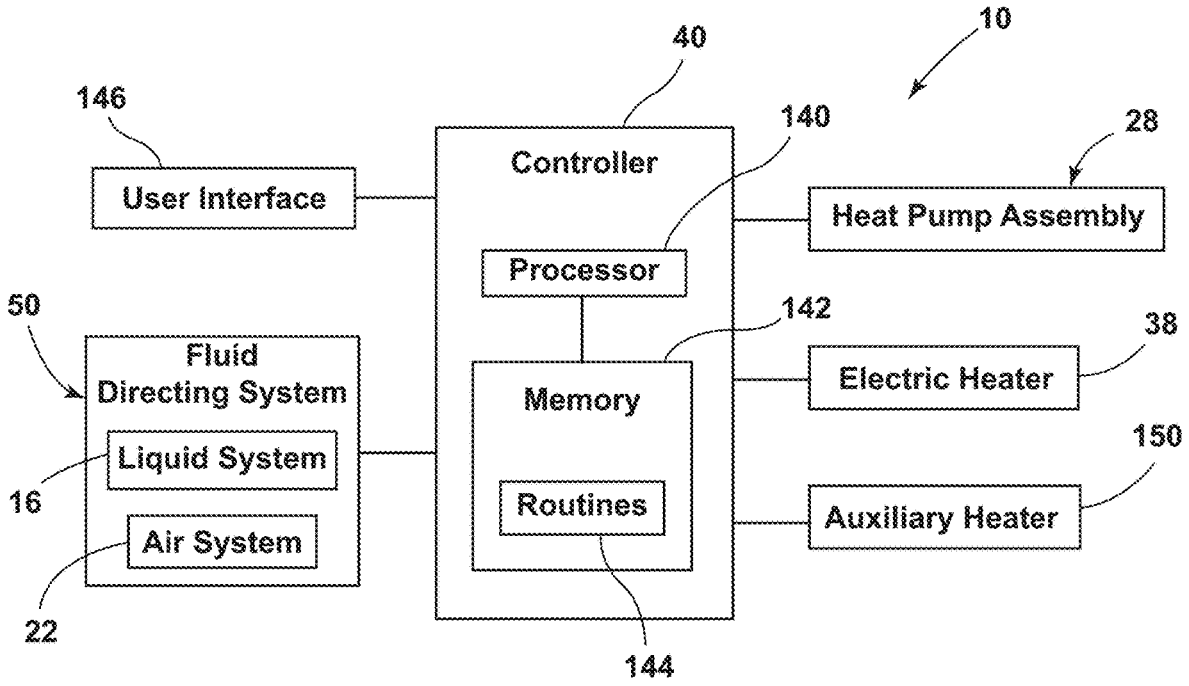
FIG. 9 is a block diagram of a combination laundry appliance, according to the present disclosure.

With reference still to FIG. 4, as well as FIG. 9, the laundry appliance 10 includes the controller 40, which is communicatively coupled with the heat pump assembly 28 and the electric heater 38. The controller 40 includes a processor 140, a memory 142, and other control circuitry. Instructions or routines 144 are stored within the memory 142 and executable by the processor 140. The controller 40, as disclosed herein, may include various types of control circuitry, digital or analog, and may include the processor 140, a microcontroller, and an application-specific integrated circuit (ASIC), or other circuitry configured to perform the various input or output, control, analysis, or other functions described herein. The memory 142, as described herein, may be implemented in a variety of volatile and nonvolatile memory formats. The routines 144 include operating instructions to enable various functions described herein.

The controller 40 is configured to activate the heat pump assembly 28, the electric heater 38, and the liquid directing system 16. The controller 40 is also configured to adjust the state of the three-way valve 36 to direct the refrigerant 102 to the first condenser 32 for the wash cycle 20. In various aspects, the controller 40 is configured to receive an input provided by the user, which may be an input through a user interface 146 connected to the laundry appliance 10 or through wireless communication therewith.

Upon receiving the input, the controller 40 is configured to determine which mode of operation was selected by the user for the wash cycle 20. In various aspects, the laundry appliance 10 is configured to operate the wash cycle 20 in multiple modes of operation, such as a power-saving mode and a time-based mode. In the power-saving mode, the controller 40 is configured to adjust the valve 36 to the first state to direct the refrigerant 102 through the first condenser 32. The wash fluid 18 is directed across the first condenser 32 to be heated. In the power-saving mode, the electric heater 38 is configured to remain in a deactivated state. Operating in the power-saving mode reduces energy consumption by the laundry appliance 10. This mode may also be referred to as an "eco-mode" or an "economical mode." The wash time may be increased based on the single component heating with the wash fluid 18, but the power consumption by the laundry appliance 10 may be decreased. The wash time in the power-saving mode is generally greater than the wash time in the time-based mode.

In the time-based mode, the wash time is configured to be shortened due to the shortened time it takes to heat the wash fluid 18 to the predefined range (e.g., between about 40° C. and about 50° C.). In the time-based mode, the controller 40 is configured to adjust the valve 36 to the first state to direct the refrigerant 102 through the first condenser 32. Additionally, in the time-based mode, the controller 40 is configured to activate the electric heater 38 and the wash fluid 18 is configured to be directed proximate to or across from the electric heater 38. In this way, the heating performed by the first condenser 32 is supplemented by the electric heater 38. The electric heater 38 may be an electrical or resistive heater 34 and can be included in the heat pump assembly 28 or in a separate location in the laundry appliance 10. With two components configured to heat the wash fluid 18, the wash fluid 18 is configured to be heated faster, decreasing the wash time. Use of the electric heater 38 generally increases the energy used by the laundry appliance 10.

Referring to FIG. 5, the airflow path 80 is illustrated relative to the components of the heat pump assembly 28 and the drum 14. The refrigerant 102 is directed from the compressor 110, through the three-way valve 36, and through the second condenser 34. The refrigerant 102 is then directed to the check valve 116, the expansion valve 112, through the evaporator 30, and back to the compressor 110. During the dry cycle 26, as illustrated in FIG. 5, the three-way valve 36 is in the second state. The refrigerant 102 bypasses the first condenser 32, such that little or no heat is emitted by the first condenser 32. Accordingly, during the dry cycle 26, substantial heat is emitted by the second condenser 34 to heat the air 24 and minimal or no heat is emitted by the first condenser 32.

The air directing system 22 is configured to direct the air 24 across various components of the heat pump assembly 28, through the drum 14, and across an auxiliary heater 150. The air 24 is directed out of the drum 14 and across the evaporator 30. As the air 24 crosses the evaporator 30, the air 24 is dried (e.g., moisture is removed) and cooled slightly. The air 24 is then directed across the second condenser 34 where the second condenser 34 is configured to heat the air 24 before the warmed and dried air 24 is directed back through the drum 14.

The air 24 is also directed across the auxiliary heater 150. In the illustrated example of FIG. 5, the auxiliary heater 150 is disposed along the airflow path 80 between the evaporator 30 and the second condenser 34. It is contemplated that the auxiliary heater 150 may be disposed along the airflow path 80 after the second condenser 34 without departing from the teachings herein. The auxiliary heater 150 may be an electric or resistive heater 150 that can be utilized to supplement heating the air 24.

In various aspects, the auxiliary heater 150 is configured to be activated for the start of the dry cycle 26 to provide an initial warming to the air 24 and then deactivated allowing the second condenser 34 to continue to warm the air 24. In another non-limiting example, the auxiliary heater 150 may be activated at intervals to supplement the heating performed by the second condenser 34. In an additional non-limiting example, the auxiliary heater 150 may remain activated during the dry cycle 26. The air 24 is continually directed across at least the evaporator 30 and the second condenser 34 to be dried and warmed throughout the drying cycle.

Referring to FIGS. 1-9, the laundry appliance 10 is a combination washer and dryer 10 configured to perform both the wash cycle 20 and dry cycle 26 in the same drum 14. The wash cycle 20 and the dry cycle 26 may be performed independently as stand-alone operations or may be performed consecutively as a comprehensive wash and dry cycle 26. The controller 40 is configured to activate the heat pump assembly 28 to adjust the three-way valve 36 between the first state in the wash cycle 20 and the second state in the dry cycle 26.

The laundry appliance 10 is configured to utilize the first condenser 32 for heating the wash fluid 18 during the wash cycle 20 and the second condenser 34 for heating the air 24 during the dry cycle 26. In this way, more heat is emitted by the first condenser 32 than the second condenser 34 during wash cycle 20 as the second condenser 34 emits minimal or no heat. Further, the refrigerant 102 may move through the first condenser 32 to generate the heat, but may not actively move through the second condenser 34 during the wash cycle 20. Moreover, more heat is emitted by the second condenser 34 than heat emitted by the first condenser 32 during the dry cycle 26 as the first condenser 32 emits minimal or no heat. The refrigerant 102 may move through the second condenser 34 to generate the heat, but may not actively move through the first condenser 32 during the dry cycle 26. Additionally, the wash cycle 20 can be performed in two different modes of operation based on a quicker wash time (e.g., the time-based mode) and a reduction in energy consumption (e.g., the power-saving mode).

Figure 10:
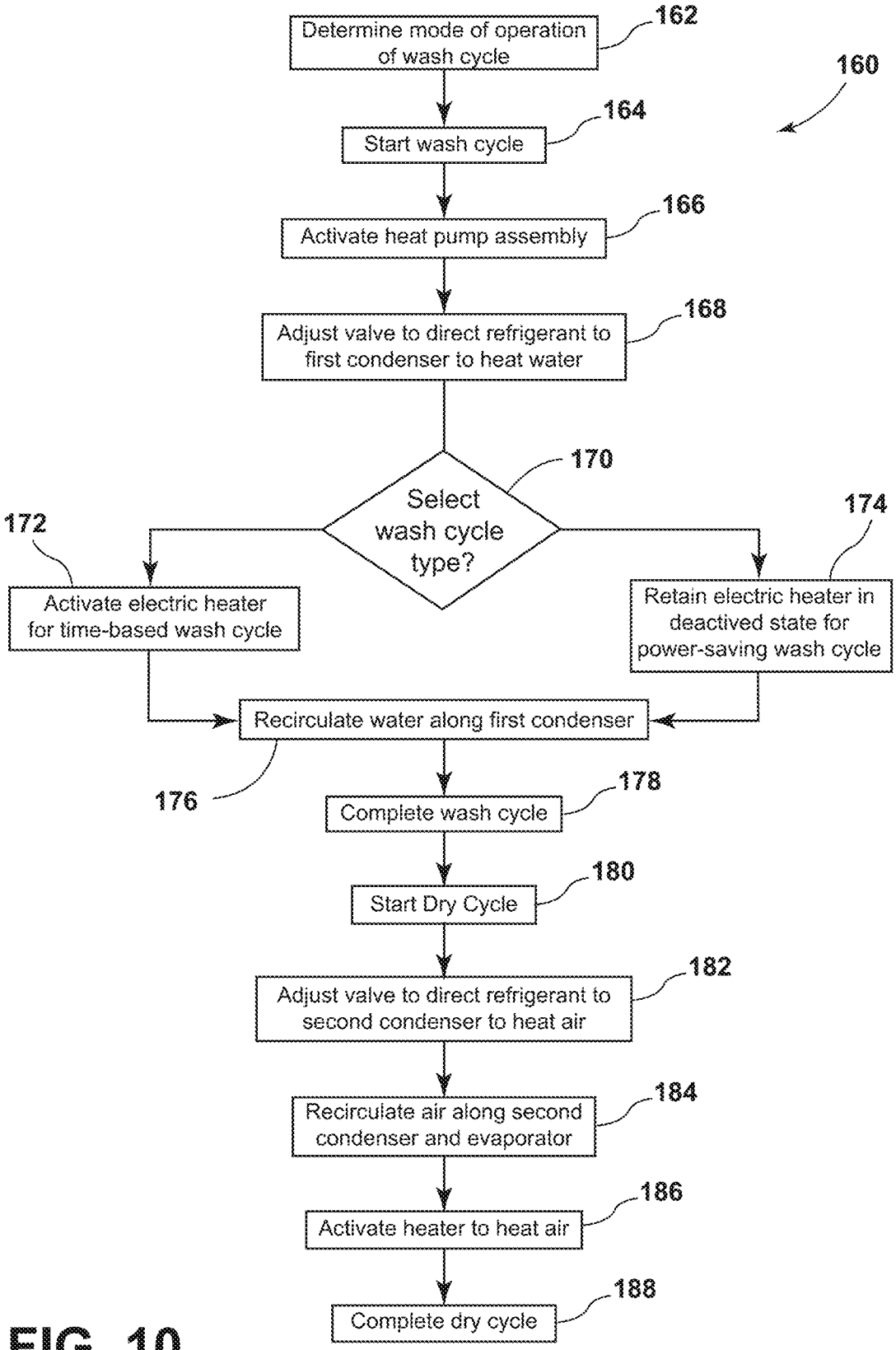
FIG. 10 is a flow diagram of a method of controlling a combination laundry appliance having a dual-condenser heat pump assembly, according to the present disclosure.

Referring to FIG. 10, as well as FIGS. 1-9, a method 160 of controlling the laundry appliance 10 includes step 162 of determining the mode of operation of the wash cycle 20. The controller 40 is configured to receive the input from the user and based on the input, determine the mode of operation. The mode of operation is the time-based mode for the wash cycle 20 or the power-saving mode of the wash cycle 20. In step 164, the controller 40 is configured to start the wash cycle 20 based on input. Step 164 may also include delivering the wash fluid 18, including the water and/or the laundry chemistry, into the drum 14 after the items have been placed in the drum 14.

In step 166, the controller 40 is configured to activate the heat pump assembly 28. In this way, the heat pump assembly 28 is configured to begin to drive the refrigerant 102 through the refrigerant circuit 100. In step 168, the controller 40 is configured to adjust the three-way valve 36 to the first state to direct the refrigerant 102 through the first condenser 32 to heat the wash fluid 18. During the wash cycle 20, the refrigerant 102 is continually directed through the first condenser 32, bypassing the second condenser 34.

In step 170, the controller 40 is configured to determine the type of wash cycle 20. In step 172, for the time-based mode for the wash cycle 20 (determined in step 162), the controller 40 is configured to activate the electric heater 38. In this way, the electric heater 38 is configured to supplement the heating of the wash fluid 18 performed by the first condenser 32. Alternatively, in step 174, for the power-saving mode for the wash cycle 20 (determined in step 162), the electric heater 38 is retained in the deactivated state. In this way, the wash fluid 18 is heated by the first condenser 32 without being supplemented by the additional electric heater 38.

In step 176, the wash fluid 18 is circulated along the first condenser 32 for a substantial portion or the entirety of the wash cycle 20. In this way, each time the wash fluid 18 is drained from the drum 14, the wash fluid 18 is heated before or as the wash fluid 18 is rerouted back to the drum 14. In step 178, the wash cycle 20 is completed, and in step 180 the dry cycle 26 is started. The dry cycle 26 may be started based on additional input or may be based on an initial input from the user.

In step 182, the controller 40 is configured to adjust the three-way valve to the second state to direct the refrigerant 102 through the second condenser 34 to heat the air 24. During the dry cycle 26, the refrigerant 102 is configured to be directed along the refrigerant circuit 100 through the second condenser 34, generally bypassing the first condenser 32. Accordingly, when the heat pump assembly 28 is operated with the laundry appliance 10 in the dry cycle 26, the first condenser 32 emits minimal to no heat.

In step 184, the air 24 is recirculated along the evaporator 30 and the second condenser 34. The air 24 is directed through the drum 14 gathering moisture and drying the items therein. The air 24 is directed out of the drum 14 and across the evaporator 30. As air 24 circulates past the evaporator 30, moisture is removed from the air 24. The air 24 is then directed along the airflow path 80 and across the second condenser 34. The second condenser 34 is configured to heat the air 24, and the heated air 24 is then directed back into the drum 14.

In step 186, the controller 40 is configured to activate the auxiliary heater 150 to assist with heating the air 24. The auxiliary heater 150 may be activated for a predefined period of time during the dry cycle 26, such as at the start of, intermittently activated, or continually activated during the dry cycle 26. The auxiliary heater 150 may also be activated based on sensed information about the items in the drum 14. In step 188, the dry cycle 26 is completed, and the user may be notified that the wash and/or dry cycles 20, 26 are complete. It will be understood that the steps 162-188 of the method 160 may be performed in any order, simultaneously, repeated, and/or omitted without departing from the teachings provided herein.

Use of the present device may provide for a variety of advantages. For example, the laundry appliance 10 may include three heat exchangers, including one evaporator 30 and two condensers 32, 34. Additionally, one condenser 32 may be utilized for the wash cycle 20, while the other condenser 34 is utilized for the dry cycle 26. In this way, more heat is emitted by the first condenser 32 than the second condenser 34 during the wash cycle 20, and more heat is emitted by the second condenser 34 than heat emitted by the first condenser 32 during the dry cycle 26. Each of the heating by the first condenser 32 and the second condenser 34 may be supplemented or initiated by the respective heater 38, 150. Moreover either the electric heater 38 or the auxiliary heater 150 may be utilized to supplement both the heating of the wash fluid 18 and the air 22. Also, the wash cycle 20 may be performed based on different predefined mode of operation, including the time-based mode and the power-saving mode. During the time-based mode, the auxiliary heater 150 can be activated to supplement the heating of the wash fluid 18 performed by the first condenser 32. In this way, the wash fluid 18 is heated quicker, shortening the wash time for the wash cycle 20. Further, the laundry appliance 10 may be operated in the power-saving mode for the wash cycle 20. In such configurations, the auxiliary heater 150 remains in the deactivated state, and the wash fluid 18 is heated via the first condenser 32, which reduces energy consumption. Additional benefits or advantages may be realized and/or achieved.

The device disclosed herein is further summarized in the following paragraphs and is further characterized by combinations of any and all of the various aspects described therein.

According to another aspect of the present disclosure, a combination washer and dryer includes a cabinet, a drum disposed within the cabinet, and a liquid directing system disposed within the cabinet. The liquid directing system is configured to direct liquid into the drum for a wash cycle. An air directing system is disposed within the cabinet and is configured to direct air into the drum for a dry cycle. A heat pump assembly is operably coupled to the liquid directing system and the air directing system. The heat pump assembly includes an evaporator, a first condenser in fluid communication with the evaporator, a second condenser in fluid communication with the evaporator, and a valve operably coupled to the first and second condensers. The valve is configured to direct refrigerant to the first condenser during the wash cycle to heat a wash fluid and to the second condenser during the dry cycle to heat the air. A heater is disposed within the cabinet. The heater is configured to selectively heat the wash fluid during a predefined mode of operation of the wash cycle. A controller is communicatively coupled to the heat pump assembly to control the valve to direct the refrigerant based on a laundry cycle.

According to another aspect, a controller is configured to selectively control a heat pump assembly to operate in a time-based mode of a wash cycle and a power-saving mode of a wash cycle. A heater is activated in the time-based mode to shorten a wash time.

According to yet another aspect, a heater is in a deactivated state during the power-saving mode of a wash cycle to conserve energy. A wash time in the power-saving mode is greater than the wash time in a time-based mode.

According to another aspect, a valve is a three-way valve operable between a first state to direct refrigerant to a first condenser and a second state to direct the refrigerant to a second condenser.

According to yet another aspect, more heat is emitted by a first condenser than a second condenser during a wash cycle, and more heat is emitted by the second condenser than heat emitted by the first condenser during a dry cycle.

According to another aspect, an evaporator is configured to reduce moisture in air during a dry cycle.

According to yet another aspect, an auxiliary heater is operably coupled to an air directing system to heat air during a dry cycle in combination with a second condenser.

According to another aspect of the present disclosure, a combination laundry appliance includes a cabinet, a drum disposed within the cabinet, a fluid directing system for directing wash fluid into the drum during a wash cycle and directing air into the drum during a dry cycle, and a heat pump assembly operably coupled to the fluid directing system. The heat pump assembly includes a first condenser, a second condenser, and a three-way valve. The three-way valve is configured to direct refrigerant to the first condenser during the wash cycle to heat the wash fluid and to the second condenser during the dry cycle to heat the air. A controller is communicatively coupled to the heat pump assembly. The controller is configured to control the three-way valve to direct the refrigerant based on a laundry cycle.

According to yet another aspect, a three-way valve is in a first state during a wash laundry cycle to direct refrigerant to a first condenser. The three-way valve is in a second state during a drying laundry cycle to direct the refrigerant to a second condenser.

According to another aspect, more heat is emitted by a first condenser than a second condenser during a wash cycle, and more heat is emitted by the second condenser than heat emitted by the first condenser during a dry cycle.

According to yet another aspect, a fluid directing system includes a liquid directing system for directing wash fluid from an inlet into a drum. The liquid directing system recirculates the wash fluid during a wash cycle.

According to another aspect, a liquid directing system recirculates a wash fluid along a first condenser to be heated throughout a wash cycle.

According to yet another aspect, a fluid directing system includes an air directing system for recirculating air during a dry cycle. The air is directed along an evaporator and a second condenser throughout the dry cycle.

According to another aspect, an electric heater is operably coupled to a fluid directing system. The electric heater is selectively activated by a controller to heat a wash fluid with a first condenser to shorten a wash time.

According to yet another aspect, a first condenser and a second condenser are arranged in parallel in a refrigerant circuit of a heat pump assembly.

According to another aspect of the present disclosure, a method of controlling a combination laundry appliance includes starting a wash cycle in a drum of said combination laundry appliance and activating a heat pump assembly to direct refrigerant through the heat pump assembly, where the heat pump assembly having a first condenser and a second condenser. The method also includes adjusting a three-way valve to a first state to direct the refrigerant through the first condenser during the wash cycle to heat wash fluid to be directed into the drum, starting a dry cycle in the drum upon completion of the wash cycle, and adjusting the three-way valve to a second state to direct the refrigerant through the second condenser during the dry cycle to heat air to be directed into the drum.

According to yet another aspect, a method includes determining a mode of operation of a wash cycle. The mode of operation is one of a time-based mode of operation and a power-saving mode of operation.

According to another aspect, a method includes activating an electric heater operably coupled with a wash fluid to heat the wash fluid during a time-based mode of a wash cycle to shorten a wash time.

According to yet another aspect, a method includes retaining the electric heater in a deactivated state in a power-saving mode of operation of a wash cycle.

According to another aspect, a step of adjusting a three-way valve to a first state includes directing refrigerant away from a second condenser during a wash cycle, and a step adjusting the three-way valve to a second state includes directing the refrigerant away from a first condenser during a dry cycle.

According to another aspect, a method includes recirculating a wash fluid along a first condenser during a wash cycle to continually heat the wash fluid.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A combination washer and dryer, comprising:
- a cabinet;
- a drum disposed within the cabinet;
- a liquid directing system disposed within the cabinet and configured to direct wash fluid into the drum for a wash cycle, wherein the liquid directing system includes a drain reservoir fluidly coupled to an interior of the drum via a drain line and a pump in fluid communication with the drain reservoir;
- an air directing system disposed within the cabinet and configured to direct air into the drum for a dry cycle;
- a heat pump assembly operably coupled to the liquid directing system and the air directing system, wherein the heat pump assembly includes:
  - an evaporator;
  - a first condenser in fluid communication with the evaporator, wherein the first condenser is disposed within the drain reservoir upstream of the pump, wherein the first condenser is a fin-and-tube condenser to maximize surface area and, consequently, heat transfer to the wash fluid in the drain reservoir;
  - a second condenser in fluid communication with the evaporator; and
  - a valve operably coupled to the first and second condensers, wherein the valve is configured to direct refrigerant to the first condenser during the wash cycle to heat the wash fluid in the drain reservoir and to the second condenser during the dry cycle to heat the air;
- a heater disposed within the cabinet, wherein the heater is configured to selectively heat the wash fluid during a predefined mode of operation of the wash cycle; and
- a controller communicatively coupled to the heat pump assembly to control the valve to direct the refrigerant based on a laundry cycle.

2. The combination washer and dryer of claim 1, wherein the controller is configured to selectively control the heat pump assembly to operate in a time-based mode of the wash cycle and a power-saving mode of the wash cycle, and wherein the heater is activated in the time-based mode to shorten a wash time.

3. The combination washer and dryer of claim 2, wherein the heater is in a deactivated state during the power-saving mode of the wash cycle to conserve energy, wherein the wash time in the power-saving mode is greater than the wash time in the time-based mode.

4. The combination washer and dryer of claim 1, wherein the valve is a three-way valve operable between a first state to direct the refrigerant to the first condenser and a second state to direct the refrigerant to the second condenser.

5. The combination washer and dryer of claim 1, wherein more heat is emitted by the first condenser than the second condenser during the wash cycle, and wherein more heat is emitted by the second condenser than heat emitted by the first condenser during the dry cycle.

6. The combination washer and dryer of claim 1, wherein the evaporator is configured to reduce moisture in the air during the dry cycle.

7. The combination washer and dryer of claim 1, further comprising:

an auxiliary heater operably coupled to the air directing system to heat the air during the dry cycle in combination with the second condenser.

8. The combination washer and dryer of claim 1, wherein the pump is disposed within the drain reservoir.

9. The combination washer and dryer of claim 1, wherein the heat pump assembly includes:

a first refrigerant line to direct the refrigerant through the first condenser from the valve;

a second refrigerant line to direct the refrigerant through the second condenser from the valve;

a check valve downstream of the first and second condensers, and wherein the first and second refrigerant lines are configured to direct the refrigerant to the check valve; and an expansion valve downstream of the check valve, wherein the refrigerant is configured to be directed from the check valve to the expansion valve.

10. The combination washer and dryer of claim 1, wherein heated wash fluid is configured to be directed from the drain reservoir to a recirculation line via the pump.

11. A combination laundry appliance, comprising:

a cabinet;

a drum disposed within the cabinet;

a fluid directing system for directing wash fluid into the drum during a wash cycle and directing air into the drum during a dry cycle, wherein the fluid directing system includes a reservoir compartment configured to receive the wash fluid from the drum via a drain line and a recirculation pump in fluid communication with the reservoir compartment;

a heat pump assembly operably coupled to the fluid directing system, wherein the heat pump assembly includes:

a first condenser disposed within the reservoir compartment upstream of the recirculation pump, wherein the first condenser is a fin-and-tube condenser to maximize surface area and, consequently, heat transfer to the wash fluid in the reservoir compartment, and wherein the wash fluid is configured to be delivered to the reservoir compartment around the first condenser to receive heat emitted by the first condenser during the wash cycle, and wherein heated wash fluid is configured to be recirculated from the reservoir compartment via the recirculation pump during the wash cycle;

a second condenser; and a three-way valve configured to direct refrigerant to the first condenser during the wash cycle to heat the wash fluid, and wherein the three-way valve is configured to direct the refrigerant to the second condenser during the dry cycle to heat the air; and a controller communicatively coupled to the heat pump assembly, wherein the controller is configured to control the three-way valve to direct the refrigerant based on a laundry cycle.

12. The combination laundry appliance of claim 11, wherein the three-way valve is in a first state during a wash laundry cycle to direct the refrigerant to the first condenser, and wherein the three-way valve is in a second state during a drying laundry cycle to direct the refrigerant to the second condenser.

13. The combination laundry appliance of claim 12, wherein more heat is emitted by the first condenser than the second condenser during the wash cycle, and wherein more heat is emitted by the second condenser than heat emitted by the first condenser during the dry cycle.

14. The combination laundry appliance of claim 11, wherein the fluid directing system includes a liquid directing system for directing the wash fluid from an inlet into the drum.

15. The combination laundry appliance of claim 14, wherein the fluid directing system includes an air directing system disposed within the cabinet and configured to direct the air into the drum for the dry cycle.

16. The combination laundry appliance of claim 11, further comprising:

an evaporator in fluid communication with the first condenser and the second condenser, wherein the fluid directing system includes an air directing system for recirculating the air during the dry cycle, and wherein the air is directed along the evaporator and the second condenser throughout the dry cycle.

17. The combination laundry appliance of claim 11, further comprising:

an electric heater operably coupled to the fluid directing system, wherein the electric heater is selectively activated by the controller to heat the wash fluid with the first condenser to shorten a wash time.

18. The combination laundry appliance of claim 11, wherein the first condenser and the second condenser are arranged in parallel in a refrigerant circuit of the heat pump assembly.

* * * * *